United States Patent [19]

Wreinert et al.

[11] Patent Number: 5,000,137

[45] Date of Patent: Mar. 19, 1991

[54] COMBUSTION ENGINE PUSH ROD AND A METHOD OF MANUFACTURING SAID PUSH ROD

[75] Inventors: Hendry Wreinert, Älghult; Lars Tenglund, Henån, both of Sweden

[73] Assignee: AB Volvo, Gothenburg, Sweden

[21] Appl. No.: 527,752

[22] Filed: May 23, 1990

[30] Foreign Application Priority Data

May 25, 1989 [SE] Sweden ..... 8901855

[51] Int. Cl.[5] ..... F01L 1/14

[52] U.S. Cl. ..... 123/90.61

[58] Field of Search ..... 123/90.61, 90.62, 90.63

[56] References Cited

U.S. PATENT DOCUMENTS

| | | | |
|---|---|---|---|
| 2,434,080 | 1/1948 | Rosa | 123/90.61 |
| 3,034,488 | 5/1962 | Reiners | 123/90.61 |
| 4,436,063 | 3/1984 | Usui | 123/90.61 |
| 4,589,384 | 5/1986 | Ott | 123/90.61 |
| 4,848,286 | 7/1989 | Bentz | 123/90.61 |

FOREIGN PATENT DOCUMENTS

| | | | |
|---|---|---|---|
| 0013204 | 1/1982 | Japan | 123/90.61 |

*Primary Examiner*—David A. Okonsky
*Assistant Examiner*—Weilun Lo
*Attorney, Agent, or Firm*—Ernest A. Beutler

[57] ABSTRACT

The invention concerns a push rod for combustion engines and a method of manufacturing said push rod. The push rod comprises a tubular intermediate member, a push rod seat element one end of which acts on a rocker arm positioned adjacent the cylinder valve and the opposite end of which is mounted on one end of the intermediate member, and a push rod end element one end of which abuts against a valve lifter positioned adjacent the camshaft and the opposite end of which is mounted on the opposite end of the intermediate member. The intermediate member is also provided with longitudinal slits positioned at the two end portions of the member, allowing the push rod seat element and the push rod end element to be mounted onto the intermediate member by being forced onto their respective end portion thereof.

6 Claims, 2 Drawing Sheets

COMBUSTION ENGINE PUSH ROD AND A METHOD OF MANUFACTURING SAID PUSH ROD

BACKGROUND OF THE INVENTION

The present invention concerns a combustion engine push rod element comprising an intermediate member, a push rod seat one end of which is intended to act on a rocker arm positioned adjacent a cylinder valve and the opposite end of which is intended to be attached to one end of the intermediate member, and a push rod end element one end of which is intended to abut against a valve lifter positioned adjacent the camshaft and the opposite end of which is intended to be connected to the opposite end of the intermediate member. The invention also concerns a method of manufacturing a push rod of this kind.

In combustions engines wherein the camshaft is in a low position, the transfer of motion from the cams of the camshaft to the various valve mechanisms of the cylinders is affected by means of push rods. In order to meet the demands both for low weight and high buckling strength tubular steel materials have been used for push rods of this kind in accordance with prior art technology.

Conventionally, the end of the push rod abutting against a valve lifter positioned adjacent the camshaft has a spherical configuration whereas the opposite push rod end which affects a rocker arm positioned adjacent the cylinder valve generally is cup-shaped.

In accordance with prior art technology both end pieces are separate components which are attached to the tube e.g. by welding. In this case welding is however a both costly and time-consuming method, in addition to which special equipment is required for its performance. As an alternative to welding the end pieces may be pressed on to the tube, a method which however requires that the various components are manufactured to strict tolerances. In addition, the tube must be machined internally.

The present invention has for its purpose to provide a push rod and a method of manufacturing a push rod, wherein the disadvantages outlined above have been removed. In addition, the invention concerns a simple method of assembling the push rod which may be performed at low costs and without requiring any or very few specialty tools. Furthermore, in mounting the end pieces onto the push rod tube it is also desirable that the forces acting on the tubular parts are reduced, allowing said parts to be manufactured with thin walls without risk that the walls will burst during assembly.

SUMMARY OF THE INVENTION

These purposes are achieved in a device and a method of the kind referred to above, which is characterised in that the end portions of the intermediate member as well as those end portions of respectively the push rod seat element and the push rod end element that are turned towards the intermediate member all have an essentially tubular cross-sectional configuration, in that at least one of the two end portions of the intermediate member is formed with at least one longitudinal slit, in that the internal diameter of the tubular end of either the push rod seat element or of the push rod end element or the tubular ends of both said elements is slightly smaller than the external diameter of the end portions of the intermediate member, and in that the push rod seat element or the push rod end element, or both, are mounted on the associated end portion or end portions of the intermediate member, whereby the end portions of said intermediate member will be able to absorb a reduction of its periphery by narrowing of the width of the longitudinal slit.

The invention also concerns a method of manufacturing a push rod of this kind, which method is characterised by forming the tubular ends of respectively the push rod seat element and the push rod end element with an internal diameter which is only slightly smaller than the external diameter of the end portions of the intermediate member, by providing both end portions of said intermediate member with at least one longitudinal slit and by mounting said push rod seal element and said push rod element on said intermediate member by compressing said push rod seat element and said push rod end element onto their associated one of the end portions of the intermediate member while reducing the periphery of the associated end portions of the intermediate member by means of narrowing of the width of said longitudinal slits.

BRIEF DESCRIPTION OF THE DRAWINGS

Further characteristics of the invention will appear from the dependent claims and the following description of a preferred embodiment. This preferred embodiment will be described in the following with reference to the accompanying drawings, wherein

DETAILED DESCRIPTION OF A PREFERRED EMBODIMENT

Figure 1:
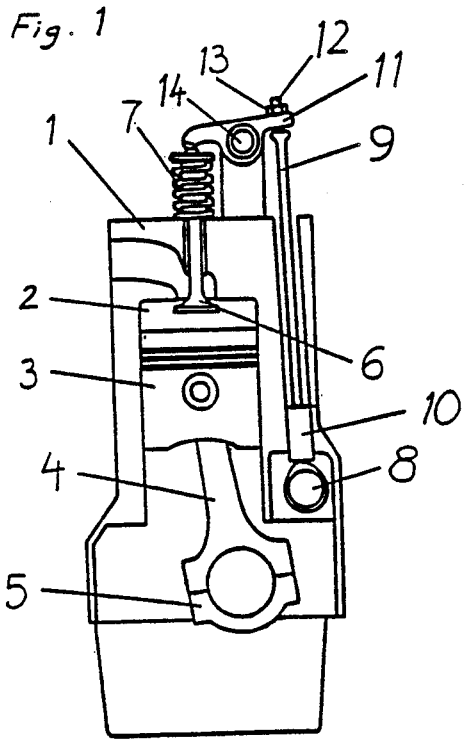
FIG. 1 is a schematical sectional view through a combustion engine including a cylinder and the push rod mechanism associated therewith.

FIG. 1 is simplified, schematical cross-sectional view of a combustion engine 1 in accordance with prior art technology. The engine 1 includes a cylinder 2 with its piston 3, a connecting rod 4 with a bearing cup 5, a cylinder valve 6 with a valve spring 7 and a low positioned camshaft 8. This type of engine is frequently referred to as a push rod engine because the transfer of movement from the camshaft 8 to the valve 6 is affected by means of a push rod 9. The push rod extends between a valve lifter 10 positioned adjacent the camshaft 8 and a rocker arm 11 positioned adjacent the valve 6, and it actuates the rocker arm 11 by means of a valve adjustment screw 12 including a valve nut 13. The rocker arm 11 is pivotally mounted on a rocker arm shaft 14. Consequently, the cams of the camshaft 8 will actuate the valve lifter 10 which in turn acts on the push rod 9. The movement is transferred further to the rocker arm 11 which exerts pressure on the valve 6.

Figure 2:
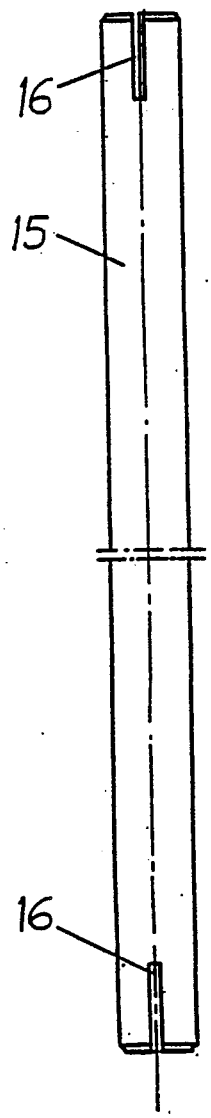
FIG. 2 illustrates a tubular intermediate member pertaining to the push rod in accordance with the invention.

FIG. 2 illustrates an intermediate member 15 included in a push rod 9 in accordance with the invention. The intermediate member 15 is made from steel and has a tubular cross-sectional shape. At each end it is formed with two longitudinal slits 16. The provision of these slits makes it possible to compress the two end portions of the rod radially. The slits 16 may be formed e.g. by forcing two rollers 19 longitudinally against the two end portions of the intermediate member 15, whereby the corresponding material is cut and pressed into the intermediate member.

Figure 3:
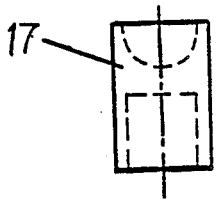
FIG. 3 shows a push rod seat element, and FIG. 4 a push rod end element.

FIG. 3 illustrates a push rod seat element 17 which is intended to be pressed onto one end portion of the intermediate member 15. One end of the push rod seat element 17 in abutment against the rocker arm 11 by means of the valve adjustment screw 12 is essentially cup-shaped whereas the opposite end of the seat element has a tubular cross-sectional shape the inner diameter of which is only slightly smaller than the external diameter of the intermediate member 15.

Figure 4:
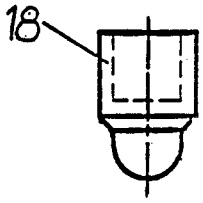

FIG. 4 illustrates a push rod end element 18 which is intended to be pressed onto the opposite end portion of the intermediate member 15. One end of the push rod end element 18 in abutment against the valve lifter 10 is essentially cup-shaped whereas the opposite end of the push rod end element has a tubular cross-sectional shape with an inner diameter which like that of the seat element 17 is only slightly smaller than the external diameter of the intermediate member 15.

Figure 5:
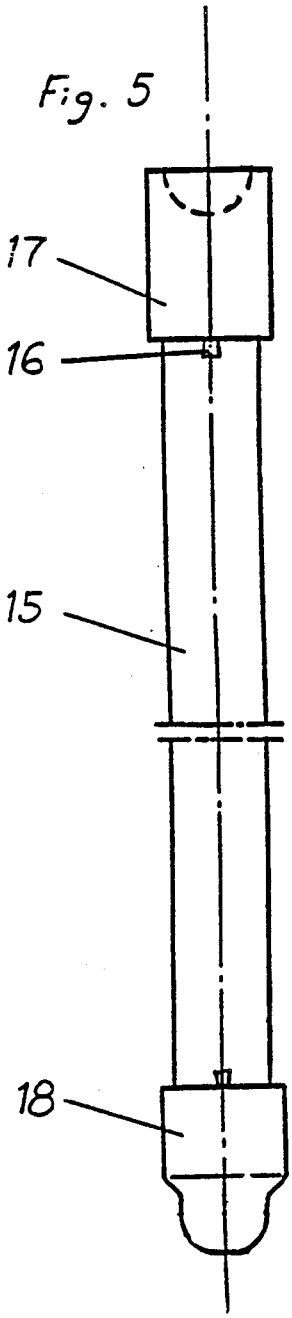
FIGS. 5 and 6 illustrate the complete push rod in accordance with the invention in its assembled position.
Figure 6:
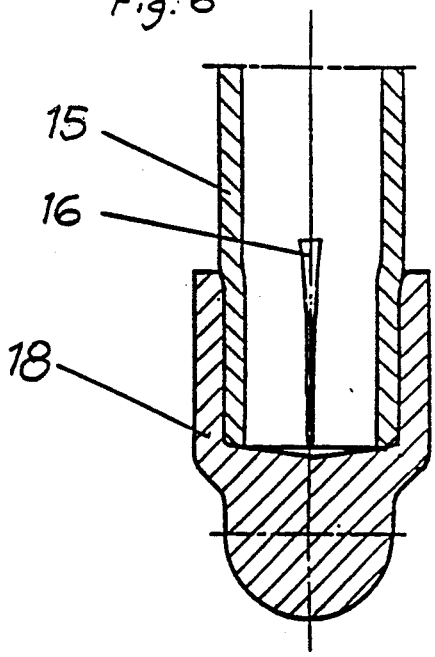

FIGS. 5 and 6 show the push rod in its fully assembled and finished condition in accordance with the present invention. In the shown position the push rod seat element 17 and the push rod end element 18 have been pressed onto the intermediate member 15 and they are retained on the end portions of said member by the frictional forces acting between the intermediate member 15 and respectively the push rod seat element 17 and the push rod end element 18. FIG. 6 shows in an enlarged cross-sectional view one end portion of the intermediate member 15 with the push rod end element 18 pressed thereonto.

Figure 7:
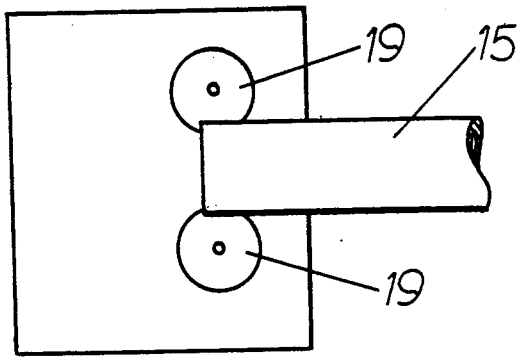
FIG. 7 illustrates schematically the method of treating the intermediate member forming part of the push rod in accordance with the invention.

The assembly of the finished push rod 9 comprises a number of part operations which advantageously are performed in an automated manufacturing process. Before the assembly, steel tubes of suitable dimension are cut to the appropriate lengths for the intermediate member 15, followed by bevelling of the end faces of the intermediate member 15. The external and internal faces of the intermediate member 15 are then cleaned, for instance by means of brushing and/or with the aid of a cleaning fluid. The following operational step consists of cutting the longitudinal slits 16 in the two end portions of the intermediate member 15. As mentioned previously, this operational step is performed by means of two cutting rollers 19 which are forced against the end portions (see FIG. 7). It goes without saying that the dimensions of the slits 16 may be modified in a variety of ways within the scope of the invention.

The next operational step consists of forcing the push rod end element 18 and the push rod seat element 17 onto their respective one of the two end portions of the intermediate member 15. A certain pressure must be exerted for this operational step to assure secure attachment of the end element 18 and the seat element 17. This operational step is advantageously combined with test loading of the now finished push rod 9. In accordance with the embodiment this test load could be in the order of 10 000 N and thus serves as a safety check of the push rod 9.

Finally, the finished push rod 9 is measured for length, ensuring that the length dimensions are kept within predetermined limits. In this manner, defect samples may be rejected.

From the drawing figures and the description above it is apparent that owing to the longitudinal slits 16 formed in the intermediate member 15 of the push rod 9 a reduction of the diameter of the two end portions of the intermediate member is possible. In this manner the push rod seat element 17 and the push rod end element 18 consequently may be forced onto and be retained on the intermediate member 15. The fitting of these parts onto the intermediate member 15 by means of pressing its facilitated by forming the end portions of the intermediate member 15 and the tubular ends of respectively the seat element 17 and the end element 18 with bevelled or rounded edges.

Finally, it should be pointed out that the invention is not limited to the embodiment described above but that various modifications are possible within the scope of the appended claims. For instance a push rod may be provided with a push rod end element and a push rod seat element both of which have either a dish-shaped or a spherical configuration. Additionally, the slits may be formed either by cutting or pressing longitudinal grooves in the end portion of the intermediate member. In this case these grooves have the function of serving as indications prior to the pressing on of the end element and the seat element onto the member.

What is claimed:

1. An improved combustion engine push rod comprising an intermediate member, a push rod seat element one end of said push rod seat element intended to act on a rocker arm positioned adjacent a cylinder valve and the opposite end of said push rod seal element intended to be attached to a first end of said intermediate member, and a push rod end element one end of which is intended to abuts against a valve lifter positioned adjacent the camshaft and the opposite end of which is intended to be connected to the opposite second end of said intermediate member, the improvement residing therein that said first and second end portions of the intermediate member as well as those end portions of respectively said push rod seat element and said push rod end element that are turned towards the intermediate member all have an essentially tubular cross-sectional configuration, in that at least one of said first or said second end portion of the intermediate member is formed with at least one longitudinal slit, in that the internal diameter of the tubular end of either the push rod seat element or of the push rod end element or the tubular ends of both said elements is slightly smaller than the external diameter of the first and second end portions of the intermediate member, and in that the push rod seat element or the push rod end element, or both, are mounted on the associated one of said first or said second end portion of the intermediate member, whereby the first and second end portions of said intermediate member will be able to absorb a reduction of their periphery by narrowing of the width of the longitudinal slit.

2. An improved push rod as claimed in claim 1, wherein the end portion of said push rod seat element positioned adjacent the rocker arm has an essentially cup-shaped configuration and in that the end portion of said push rod end element positioned adjacent the valve lifter has an essentially spherical configuration.

3. An improved push rod as claimed in claim 1, wherein the end portion of said push rod seat element positioned adjacent the rocker arm and the end portion of said push rod end element positioned adjacent the valve lifter have an essentially cup-shaped configuration.

4. An improved push rod as claimed in claim 1, wherein the end portion of said push rod seat element positioned adjacent the rocker arm and the end portion of said push rod end element positioned adjacent the valve lifter have an essentially spherical configuration.

5. An improved push rod as claimed in claim 1, comprising a plurality of slits formed adjacent said first and second end portions of the intermediate member, said slits spaced around the periphery of the intermediate member in such a manner as to divide said periphery into segments of a circle of essentially equal size.

6. An improved method of manufacturing a combustion engine push rod, said push rod comprising an intermediate member with first and second end portions of an essentially tubular cross-sectional configuration, a push rod seat element one end of said seat element arranged to act on a rocker arm positioned adjacent a cylinder valve and the opposite end of said seat element having an essentially tubular cross-sectional configuration and being intended for mounting on a first end of said intermediate member, and a push rod end element one end of said end element intended to abut against a valve lifter positioned adjacent the camshaft and the opposite end of said end element having an essentially tubular cross-sectional shape and being intended for mounting on the opposite, second end of said intermediate member, the improvement comprising forming the tubular ends of respectively said push rod seat element and said push rod end element with an internal diameter only slightly smaller than the external diameter of the first and second end portions of the intermediate member, providing both said first and said second end portions of said intermediate member with at least one longitudinal slit and mounting said push rod seat element and said push rod end element on said intermediate member by compressing said push rod seat element and said push rod end element onto their associated one of said first and said second end portions of the intermediate member while reducing the periphery of the associated first and second end portions of the intermediate member by means of narrowing of the width of said longitudinal slits.

* * * * *